US006378783B1

(12) United States Patent
Ballu

(10) Patent No.: US 6,378,783 B1
(45) Date of Patent: Apr. 30, 2002

(54) AUTOMATIC GUN WITH A MEMBRANE FOR SPRAYING A PRODUCT

(75) Inventor: Patrick Ballu, Epernay (FR)

(73) Assignee: Excel Industries, Epernay (FR)

( * ) Notice: Subject to any disclaimer, the term of this patent is extended or adjusted under 35 U.S.C. 154(b) by 0 days.

(21) Appl. No.: 09/599,013

(22) Filed: Jun. 22, 2000

(30) Foreign Application Priority Data

Jun. 23, 1999 (FR) ..... 99 07997

(51) Int. Cl.[7] ..... B05B 1/28

(52) U.S. Cl. ..... 239/290; 239/99; 239/101; 239/67; 239/296; 239/526; 239/583; 251/62

(58) Field of Search ..... 239/99, 101, 67, 239/290, 296, 525, 526, 527, 528, 574, 583, DIG. 14; 251/62, 63

(56) References Cited

U.S. PATENT DOCUMENTS 2,908,422 A 10/1959 Braun
4,141,231 A 2/1979 Kudlich
4,142,684 A * 3/1979 Schweitzer ..... 239/99 X
4,669,660 A 6/1987 Weber et al.
5,398,873 A * 3/1995 Johnston et al. ..... 239/99

FOREIGN PATENT DOCUMENTS

| | | |
|---|---|---|
| EP | 0904842 A2 | 3/1999 |
| FR | 2674451 | 10/1992 |
| SU | 1366226 | 4/1986 |

* cited by examiner

*Primary Examiner*—Steven J. Ganey
(74) *Attorney, Agent, or Firm*—Young & Thompson

(57) ABSTRACT

A gun for spraying a product such as paint supplied under constant pressure to the gun, includes a structure for the pulsed spraying of the product that includes a nozzle and an oscillating membrane associated with an intermittent closure device for supplying the product toward the nozzle. A control for the pulsed spray structure of the product is provided. A closure mechanism with a plunger is secured to the membrane and passes through the membrane to be connected to the control.

15 Claims, 1 Drawing Sheet

AUTOMATIC GUN WITH A MEMBRANE FOR SPRAYING A PRODUCT

BACKGROUND OF THE INVENTION

This application corresponds to French application No. 99 07997 filed Jun. 23, 1999, the disclosure of which is incorporated herein by reference.

The invention relates to an automatic gun with a membrane used to spray products, in particular to spray paint, abrasives or enamel, hydrosoluble or dissolved in a solvent.

There exist spray guns in which the spraying of the product is obtained exclusively by hydrostatic means, which is to say by applying a pressure to the product and causing it to exit through a nozzle at the front end of the gun. The spraying can also be obtained by pneumatic means, but generally, recourse is had to a combination of the two, which is to say that the spraying by hydrostatic means is combined with compressed air jets which, in addition to a central air spray jet, serve to adjust the shape and/or the size of the jet of sprayed product.

To adjust the supply of the product toward the nozzle and above all to cut off the supply when the gun is not actuated, conventional automatic guns without a membrane use a plunger which closes the outlet of the product through the nozzle. Retraction of the plunger to free this outlet is controlled by pneumatic control means which act on the piston of a jack moving the plunger rearwardly. When the control means are no longer actuated, a return spring acts on the jack in the opposite direction to move the plunger forwardly so as to close the outlet.

The invention relates more particularly to automatic guns with a membrane in which the membrane is controlled by pulsed air such that the product, which is supplied to the gun under constant pressure, leaves the nozzle in an intermittent spray.

In known automatic guns with a membrane, the membrane is driven in oscillatory movement by pneumatic control means for the pulsed closure of the supply of the product comprising a pulsed air supply which communicates with an annular chamber formed in the body of the gun about the rod of a control piston which, when it is actuated by pulsed air, is moved rearwardly against the action of a resilient return means. The piston thus carries out a reciprocating movement at the frequency of the pulsed air.

The forward end of the piston rod rests against the membrane, in a central region of the latter, so as to impart to it an oscillatory movement. The product to be sprayed is supplied under pressure to a reception chamber for the product which is located immediately before the membrane and which rearwardly is delimited, by the latter. This reception chamber communicates through a central opening with a central supply channel for the product arranged in the spray head and which opens directly into the nozzle.

When the control means for the pulsed air is not actuated, and also between two successive pulses, the central opening is closed by intermittent closure means constituted by the membrane itself which then is pressed by the end of the piston rod against the peripheral region about the opening which thus forms a seat. For this purpose, the diameter of the end of the piston rod is substantially greater than the internal diameter of the opening.

However, this seat is thus located at one of the ends of the central channel whose opposite end opens into the nozzle, which means that when the control means for the pulsed air is not actuated, which is to say when the spraying is stopped, all the volume of the central channel constitutes a residue of the product whose flow through the nozzle cannot be prevented, thereby giving rise to soiling.

Another drawback of this gun resides in the fact that the closure and the freeing of the opening toward the central channel during oscillation of the membrane are imprecise and do not permit good operation of these intermittent tent closure means for the supply of the product under constant pressure at frequencies which in this technical field are considered as high and which are of the order of 4 Hz.

This spray gun with a membrane moreover comprises means for the supply of pulsed spray air opening adjacent the spray nozzle to improve the spraying and to form the jet of the product. The spray air is supplied independently of the pulsed output of the product with the help of a programmable dispenser which supplies the spray air into an annular chamber formed in the spray head and which communicates with a first set of openings or outlet tubes for air opening quite near the outlet of the nozzle and with a second set of openings located in a ring at the forward end of the body of the gun. This arrangement permits the openings of this second set of openings to direct jets of spray air at a much greater angle toward the jet of product leaving the nozzle.

However, this independent supply of spray air requires an entire assembly of additional circuits and moreover, the dispenser which controls the spray air supply requires complicated and costly adjustments, which constitutes a further very great drawback.

A general problem associated as well with membrane spray guns as with the others which operate with a plunger, resides in the fact that certain pieces are very exposed to wear, in particular when the product is an abrasive product such as a paint comprising enamel. This affects first of all the nozzle, but also the membrane in the case of membrane spray guns and the plunger in the case of plunger spray guns. All these wear members thus require regular replacement which must take place more or less frequently as a function of the abrasive character of the product. It is thus desirable to be able to prolong the lifetime of these wear pieces and/or to facilitate their replacement.

SUMMARY OF THE INVENTION

The invention has for its object to overcome all these drawbacks mentioned above by providing an automatic membrane gun which avoids soiling by flow of a residue of the product when the gun is stopped, which operates without the problems at a high frequency with a free and immediate response to the pulsations of the membrane, which is provided with a simple spray air supply and of which at least certain of the wear members are designed so as to permit increased lifetime and/or easy replacement.

The object of the invention is an automatic membrane spray gun for the spraying of a product such as a paint supplied under constant pressure to the gun, comprising pulsed spray means for the product comprising an oscillation member associated with intermittent closure means for the supply of the product toward a nozzle, and control means of said pulsed spray means for the product, characterized in that said closure means comprise a plunger secured to the membrane and passing through the latter so as to be connected to a pulsation control member.

According to other characteristics of the invention:

- the plunger is fixed to the membrane by gripping means disposed on opposite sides of the membrane;
- the gripping means are constituted by clamps secured to the plunger and disposed on opposite sides of the membrane so as to grip it between them;

the forward end of the plunger extends into a central channel provided in a spray head, and the plunger can come into bearing against a seat arranged in the central channel immediately behind the nozzle;

in a gun of the type comprising pulsed air supply means for spraying, opening adjacent the spray nozzle, and control means for said pulsed air supply means for spraying, said control means of said pulsed spray means of the product comprise also said control means of said pulsed supply means for the spray air;

the end of the plunger is constituted by an interchangeable ferrule;

the ferrule of the plunger is of synthetic resin;

on the side in contact with the product, the membrane is clad with a layer of polytetrafluorethylene.

BRIEF DESCRIPTION OF THE DRAWINGS

The invention will now be described in greater detail with reference to a non-limiting example of one embodiment of the gun according to the invention, with reference to the accompanying drawings, in which.

DESCRIPTION OF THE PREFERRED EMBODIMENTS

Figure 1:
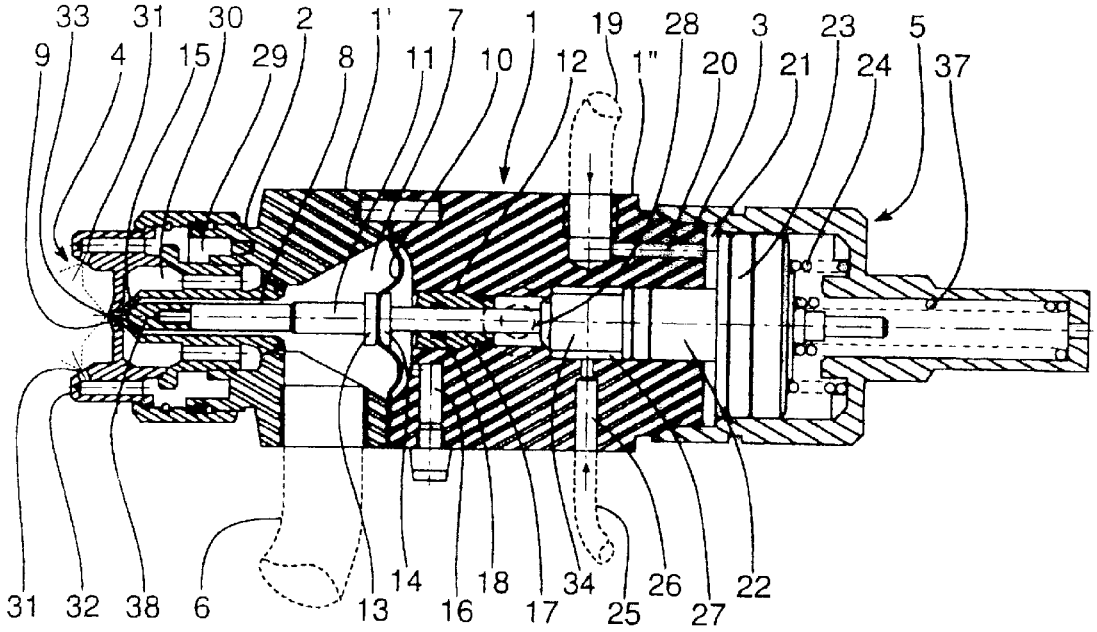
FIG. 1 is a schematic longitudinal cross-sectional view of a spray gun with a membrane according to the invention, seen in its stopped position corresponding to its position between two successive pulsations of the control means of pulsed spray of the product.

The automatic gun shown in the drawing is a membrane gun of the type in which spraying the product is obtained by pulsed spraying of the product supplied to the gun under constant pressure, in combination with a pulsed spray air supply which, in addition to spraying, permits adjusting the shape and/or dimensions of the jet of sprayed product. The process of spraying and adjustment of the jet of sprayed product by compressed air jets is well known and, not forming a part of the invention, will therefore not be described in detail.

The gun comprises a body 1 which preferably is of light metal. This body is at its front and rear ends prolonged by a front cylindrical protuberance 2 and a rear protuberance 3, which are externally screw-threaded. The front protuberance carries a spray head 4 and the rear protuberance carries a cap 5 within which are disposed the control means for the intermittent output of the product to be sprayed.

The product is supplied under constant pressure by a tube 6 in a product supply chamber 7 arranged in the front portion of the gun and having an overall truncated conical shape with the end of lesser diameter opening directly into a central channel 8 of the spray head 4 which connects the product supply chamber 7 to a spray nozzle 9. The means permitting obtaining pulsed spraying of the product comprise a membrane 10 disposed at the larger diameter end of the truncated conical supply chamber 7.

The periphery of the membrane 10 is fixed by gripping between a front portion 1' and a rear portion 1" of the body 1. These two portions 1' and 1" are assembled by screwing and must be separated for changing the membrane 10 as a result of wear caused by the product on the forward surface of the membrane. The membrane is of a material such as nitrile rubber. The surface exposed to this wear is, according to the invention, clad with a layer of polytetrafluorethylene (PTFE), which substantially increases the lifetime of the membrane.

For the pulsed spraying of the product at the level at a nozzle, the membrane 10 is according to the invention mounted oscillably with the aid of a plunger 11 extending in a central throughbore 12 of the second portion 1" of the body 1 and which is connected to control means compressing a reciprocating movement on this plunger. The plunger 11 passes through the membrane 10 through a central hole (not shown) in the latter and is secured to this latter by gripping means constituted by clamps 13, 14 secured to the plunger and disposed on opposite sides of the membrane 10 so as to grip it between them.

The forward end of the plunger can, as shown in FIG. 1, come into bearing against a seat 15 immediately behind the nozzle so as to constitute together intermittent closure means for the supply of the product under pressure to the nozzle. The product passes from the product inlet chamber 7 to the nozzle 9 through an annular space defined between the internal wall of the central channel 8 and the external surface of the plunger. The space behind the membrane 10 in the product inlet chamber is connected to the outside by a conduit 16.

The plunger 11 is guided in a guide sleeve 17 disposed within the central bore 12 and provided with sealing joints 18.

The nozzle 9 thus constitutes with the plunger 11 and the membrane 10, pulsed spray means for the product controlled by pneumatic control means comprising a pulsed air supply conduit 19 connected to a conduit 20 which opens into an annular chamber 21 formed about a piston rod 22 extending into the central bore 12 to be connected to its piston 23 which is guided in the cap 5.

The pulsed air arriving from the tube 19 is supplied to the annular chamber 21 so as to press the piston 23 back against the force of return spring 24 which bears on the one hand against the piston and on the other hand against an internal wall of the gap 5. There is obtained a reciprocate or a movement of the piston 23 and as a result also of the plunger 11 which drives the membrane 10 with oscillatory 20 movement.

FIG. 1 shows the advance position of the plunger between two control air pulses admitted into the annular chamber 21 by the air conduit 20, this position corresponding also to the position of the plunger when the gun is stopped. In this latter case, there is no loss of product through the nozzle 9, because the end of the plunger is located bearing against the seat 15 immediately behind the nozzle.

Figure 2:
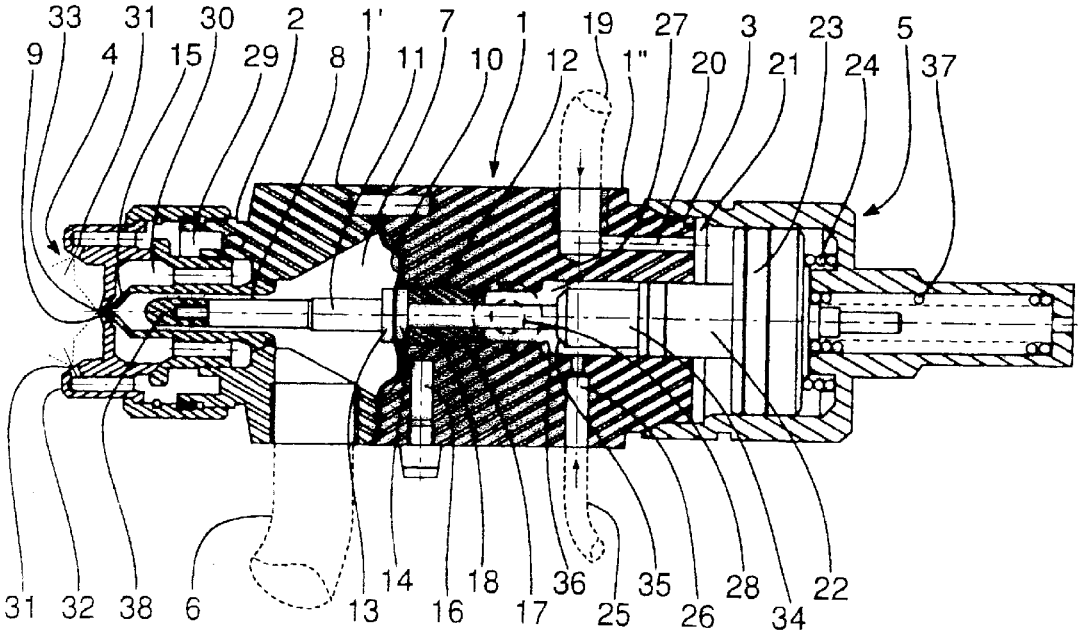
FIG. 2 is a schematic longitudinal cross-sectional view of the gun of FIG. 1, when in its spraying position in which both the pulsed spraying of the product and the pulsed supply of spraying air are actuated.

When the piston 23 is pressed back by a pulse of control air toward the rear, by compressing the spring 24, to the retracted position shown in FIG. 2, the end of the plunger 11 leaves its seat 15 to free the access of the spray nozzle 9 to the product under pressure which passes from the product inlet chamber 7 to the nozzle through the annular space defined between the internal wall of the central channel and the external surface of the plunger. At the same time, the central region of the membrane 10 is drawn rearwardly to fill to the maximum the product inlet chamber 7.

Between two control air pulses, the device returns to the position shown in FIG. 1 by a movement of the piston 23 forwardly, under the force of the return spring 24, thereby to move the plunger 11 forwardly by driving the membrane from a central region of the latter and this until the plunger comes into bearing against its seat 15 so as to close the access of the product to the nozzle.

To improve the spraying and so as better to form the jet of pulverized product which leaves the spray nozzle 9, the gun is also provided with pulsed spray air supply means opening adjacent the spray nozzle 9. These supply means for spray air comprise a compressed air tube 25 connected to an air conduit 26 opening into an overall circular air inlet chamber 27 arranged about this plunger 11 in the rear portion 1' of the body 1 of the gun. This air inlet chamber 27 is, by means of another air conduit whose opening 28 is indicated in the drawing and which extends into the front and rear portion of the body 1, connected to an external circular chamber 29 arranged in the spray head 4. This external chamber 29 is in communication with an internal circular chamber 30 and the two chambers are in known manner connected to the atmosphere by openings through the front surface of the spray head 4.

The opening 31 of the external chamber 29 are arranged in a ring 32 disposed on the front surface of the spray head 4, coaxially with the outlet of the nozzle 9. These openings 31 form within the ring 32 jets or air and converging toward the product jet.

The openings 33 of the internal chamber 30 form adjacent the product outlet of the spray nozzle 9, jets of air directed outwardly and diverging to delimit laterally the jet of product.

The control means of these spray air supply means are, for the pulsed air supply, comprised in the control means of the pulsed product spray means. According to the invention, the plunger 11 also forms a valve permitting the pulse supply of spray air. For this purpose, the plunger comprises a valve body 34 constituted by a cylindrical portion of larger diameter which at its rear end is connected to the piston rod 22 and which at its forward end comprises a first bevelled shoulder 35 adapted to coact with a complementary bevelled shoulder 36 of the first and arranged with the central channel 8 immediately in front of the inlet chamber 27 for compressed air. This second shoulder constitutes a seat for the valve body 34.

In the position shown in FIG. 1, which corresponds to a position of the device between successive control air pulses and a stop position, the valve comprised by the first and second shoulders 35, 36 serves as a closure means and prevents the supply of spray air toward the spray head 4.

Under the force of a pulse impressed on the piston 23 which moves the plunger 11 rearwardly, the valve body 34 leaves the seat 36 to free the passage of spray air toward the spray head. This opening and closing cycle of the valve is repeated for each pulse.

So as to obtain a slight delay of opening of the plunger 11 relative to the opening of the valve 34 such that the supply of spray air begins just before the intermittent outlet of the product, a second return spring 37 is disposed within the cap 5 to control the movement of the plunger. This second return spring 37 bears on the one hand on the rear end of the plunger and on the other hand on the cap 5 to urge the forward end of the plunger against the seat 15 for the latter. There is a slight axial play between the piston 23 and the rear end of the plunger 11, which results in that at the beginning of a control air pulse, the plunger opens with a slight delay relative to the valve 34 and when the pulse terminates, the plunger 11 closes slightly before the valve 34.

Thanks to the invention, there is thus obtained a membrane spray gun in which there is no need for a separate dispenser to control the supply of spray air and there can be applied without problems a high frequency of operation with free and immediate response.

So as to improve the resistance to wear of the pieces which are the most exposed, the invention provides several solutions.

Thus, the membrane which ordinarily is made of nitrile rubber, can preferably be clad with a layer of polytetrafluorethylene, which considerably increases the lifetime of this piece.

To avoid having to disassemble the entire gun to carry out changing of the assembly of the intermittent closure means, the end of the plunger is, according to the invention, constituted by an interchangeable tip 38 which is simply fixed by screwing. To change this tip, it suffices to remove the spray head to have access to it. Moreover, to improve the resistance to wear of this tip, it can preferably be made of a synthetic resin suitable for the product to be sprayed.

Thanks to the fact that the nozzle is closed by a plunger whose closure end is located immediately behind the nozzle, there is no longer risk of flowing of the product through the opening of the nozzle when the gun is stopped.

Other modifications are of course possible without thereby departing from the scope of the invention.

What is claimed is:

1. An automatic membrane gun for spraying a product supplied under constant pressure to the gun, comprising:

pulsed spray product means for pulsed spraying of the product comprising an oscillating membrane associated with intermittent closure means in a product supply chamber for supplying a product toward a nozzle; and control means for said pulsed product spray means, said intermittent closure means comprising a plunger secured to the membrane and passing through the membrane and connected to said control means, said membrane being at an end of the product supply chamber adjacent to said control means.

2. Gun according to claim 1, wherein the plunger is fixed to the membrane by gripping means disposed on opposite sides of the membrane.

3. Gun according to claim 2, wherein the gripping means are constituted by clamps secured to the plunger and disposed on opposite sides of the membrane so as to grip the membrane between the clamps.

4. Gun according to claim 1, wherein the forward end of the plunger extends through a central channel provided in a spray head, the plunger being adapted to bear against a seat provided in the central channel immediately behind the spray nozzle.

5. Gun according to claim 1, comprising pulsed air supply means opening adjacent the spray nozzle, and control means for said pulsed spray air supply means, said control means of said pulsed product spray means comprising also said control means of said pulsed spray air supply means.

6. Gun according to claim 1, wherein a forward end of the plunger is constituted by an interchangeable tip.

7. Gun according to claim 6, wherein the tip of the plunger is of synthetic resin.

8. Gun according to claim 1, wherein on the contact side with the product, the membrane is clad with a layer of polytetrafluorethylene.

9. An automatic membrane gun for spraying a product supplied under constant pressure to the gun, the gun comprising:

pulsed spray product means for pulse spraying the product, said pulsed product means comprising an oscillating membrane and intermittent closure means for supplying the product to a nozzle, said intermittent closure means comprising a plunger that is secured to said membrane with clamps disposed on opposite sides of said membrane and that grip said membrane between said clamps; and control means for controlling said pulsed spray product means.

10. An automatic membrane gun for spraying a product supplied under constant pressure to the gun, the gun comprising:

pulsed spray product means for pulse spraying the product, said pulsed product means comprising an oscillating membrane and intermittent closure means for supplying the product to a nozzle, said intermittent closure means comprising a plunger that is secured to said membrane;

control means for controlling said pulsed spray product means; and an opening adjacent to said nozzle that provides pulsed air, the pulsed air being provided to said opening by said control means.

11. An automatic membrane gun for spraying a product supplied under constant pressure to the gun, the gun comprising:

pulsed spray product means for pulse spraying the product, said pulsed product means comprising an oscillating membrane and intermittent closure means for supplying the product to a nozzle, said intermittent closure means comprising a plunger that is secured to said membrane, said plunger having an interchangeable tip; and control means for controlling said pulsed spray product means.

12. An automatic membrane gun for spraying a product supplied under constant pressure to the gun, the gun comprising:

an oscillating plunger extending through a product supply chamber, said plunger having a tip at one end that opens and closes a nozzle to permit passage of the product from said product supply chamber to said nozzle;

an oscillating membrane attached to said plunger at an end of said product supply chamber remote from said nozzle, said plunger extending through said membrane;

a pulsed air supply conduit connected to a piston that oscillates in response to pulsed air from said pulsed air supply conduit, a second end of said plunger being connected to said piston so that said plunger and said membrane oscillate with said piston.

13. The gun of claim 12, wherein said plunger is secured to said membrane with clamps disposed on opposite sides of said membrane and that grip said membrane between said clamps.

14. The gun of claim 12, further comprising a first opening adjacent to said nozzle that provides pulsed air, an air inlet chamber surrounding said piston between said membrane and said piston, and a second opening in said air inlet chamber that is in communication with said first opening to provide the pulsed air thereto.

15. The gun of claim 12, wherein said tip of said plunger is interchangeable.

* * * * *